US007658624B2

(12) United States Patent
Fang et al.

(10) Patent No.: US 7,658,624 B2
(45) Date of Patent: Feb. 9, 2010

(54) ELECTRICAL CONNECTOR ASSEMBLY HAVING CONTACTS WITHOUT SOLDERING LEGS

(75) Inventors: Zhi-Hong Fang, Kunshan (CN); Yu-Hua Mao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,417

(22) Filed: Dec. 22, 2008

(65) Prior Publication Data

US 2009/0163050 A1 Jun. 25, 2009

(30) Foreign Application Priority Data

Dec. 21, 2007 (CN) ..... 2007 1 0302447

(51) Int. Cl.
*H01R 12/00* (2006.01)

(52) U.S. Cl. ..... 439/79

(58) Field of Classification Search ..... 439/83, 439/79, 607

See application file for complete search history.

(56) References Cited

U.S. PATENT DOCUMENTS

2002/0004337 A1 1/2002 Chiang

FOREIGN PATENT DOCUMENTS

JP 11-121118 4/1999

*Primary Examiner*—Briggitte R Hammond
(74) *Attorney, Agent, or Firm*—Andrew C. Cheng; Wei Te Chung; Ming Chieh Chang

(57) ABSTRACT

An electrical connector (100) assembled to a printed circuit board (5) for connecting with a mating connector, includes a longitudinal insulative housing (1) and a plurality of contacts (2, 3) received in the housing. Each of the contacts (2, 3) defines a retaining section (20, 30), a contacting portion (21) extending forwards from the retaining section for contacting with the mating connector and a compressing portion (220, 320) extending rearwards from the retaining section for connecting to the printed circuit board. The compressing portions are arranged in two rows, and the compressing portions nip and elastic compress against the printed circuit board instead of being soldered thereto to connect the electrical connector to the printed circuit board steadily.

12 Claims, 10 Drawing Sheets

ELECTRICAL CONNECTOR ASSEMBLY HAVING CONTACTS WITHOUT SOLDERING LEGS

BACKGROUND OF THE INVENTION

1. Field of the Invention

The present invention relates to an electrical connector assembly, and more particularly to an electrical connector assembly including an electrical connector being connected to a printed circuit board without soldering.

2. Description of the Related Art

Japanese Unexamined Patent No. 11-121118 discloses a sunk-type electrical connector which suits for miniaturization. The electrical connector includes an insulative housing and a plurality of contacts retained in the housing. A rear portion of each contact is bent upwards firstly and then downwards to be soldered to a printed circuit board from a contacting portion. As a result it makes the structure of the contacts complication.

U.S. Patent Application Publication No. 2002/0004337 A1 discloses another electrical connector. The electrical connector includes an insulative housing, a shell covering on the housing and a plurality of contacts retained in the housing. The housing defines a pair of retaining portion extending rearwards from a rear face at two opposite ends thereof, and each retaining portion defines a slot opening rearwards thereof. A printed circuit board is inserted into the slots and the soldering legs are positioned on two opposite sides to nip the printed circuit board. The soldering legs are soldered to the printed circuit board, which is still a conventional assembly method of the connector to the PCB.

Hence, an electrical connector assembly including an electrical connector being connected to a printed circuit board without soldering is required.

SUMMARY OF THE INVENTION

Accordingly, an object of the present invention is to provide an electrical connector assembly including an electrical connector being connected to a printed circuit board by the compressing portions of the contacts elastically compressing against the printed circuit board.

In order to achieve the object set forth, an electrical connector assembled to a printed circuit board for connecting with a mating connector, includes a longitudinal insulative housing and a plurality of contacts received in the housing. Each of the contacts defines a retaining section, a contacting portion extending forwards from the retaining section for contacting with the mating connector and a compressing portion extending rearwards from the retaining section for connecting to the printed circuit board. The compressing portions are arranged in two rows, and the compressing portions nip and elastic compress against the printed circuit board instead of being soldered thereto to connect the electrical connector to the printed circuit board steadily.

Other objects, advantages and novel features of the invention will become more apparent from the following detailed description of the present embodiment when taken in conjunction with the accompanying drawings.

BRIEF DESCRIPTION OF THE DRAWINGS

FIG. 6, FIG. 7 and FIG. 8 are cross-sectional views of the connector taken along line 6-6 of FIG. 5, wherein FIG. 7 shows the connector is being assembled to a printed circuit board, and FIG. 8 shows the connector completely assembled to the printed circuit board;

DETAILED DESCRIPTION OF THE INVENTION

Figure 1:
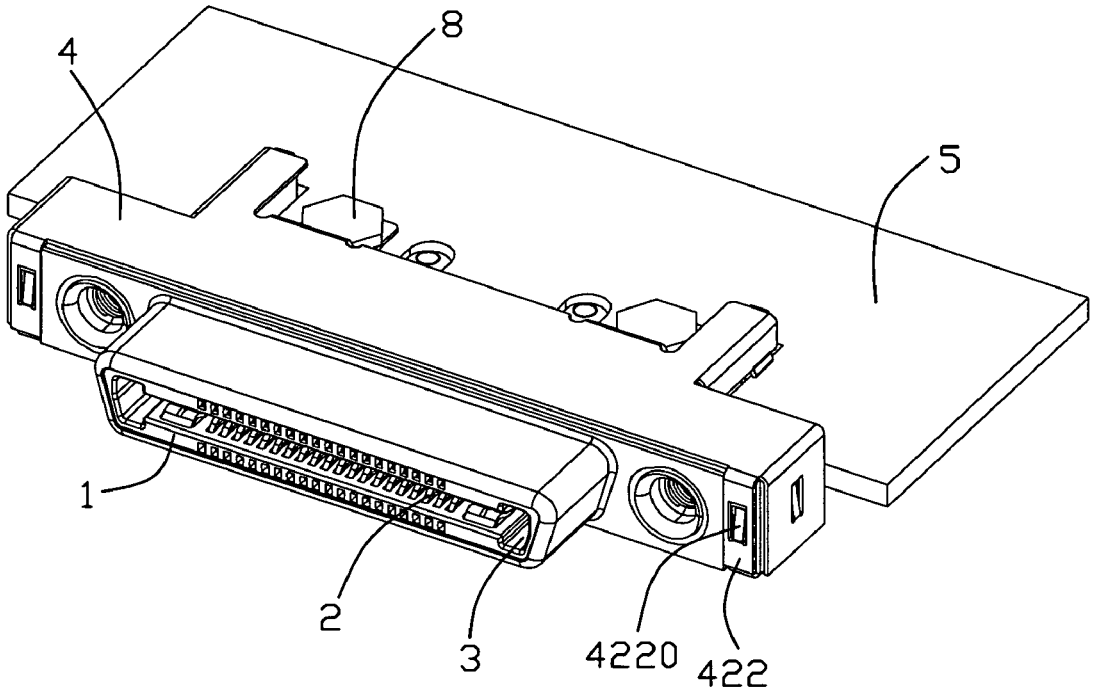
FIG. 1 is a perspective view of an electrical connector assembly.

Reference will now be made to the drawing figures to describe a preferred embodiment of the present invention in detail.

Figure 2:
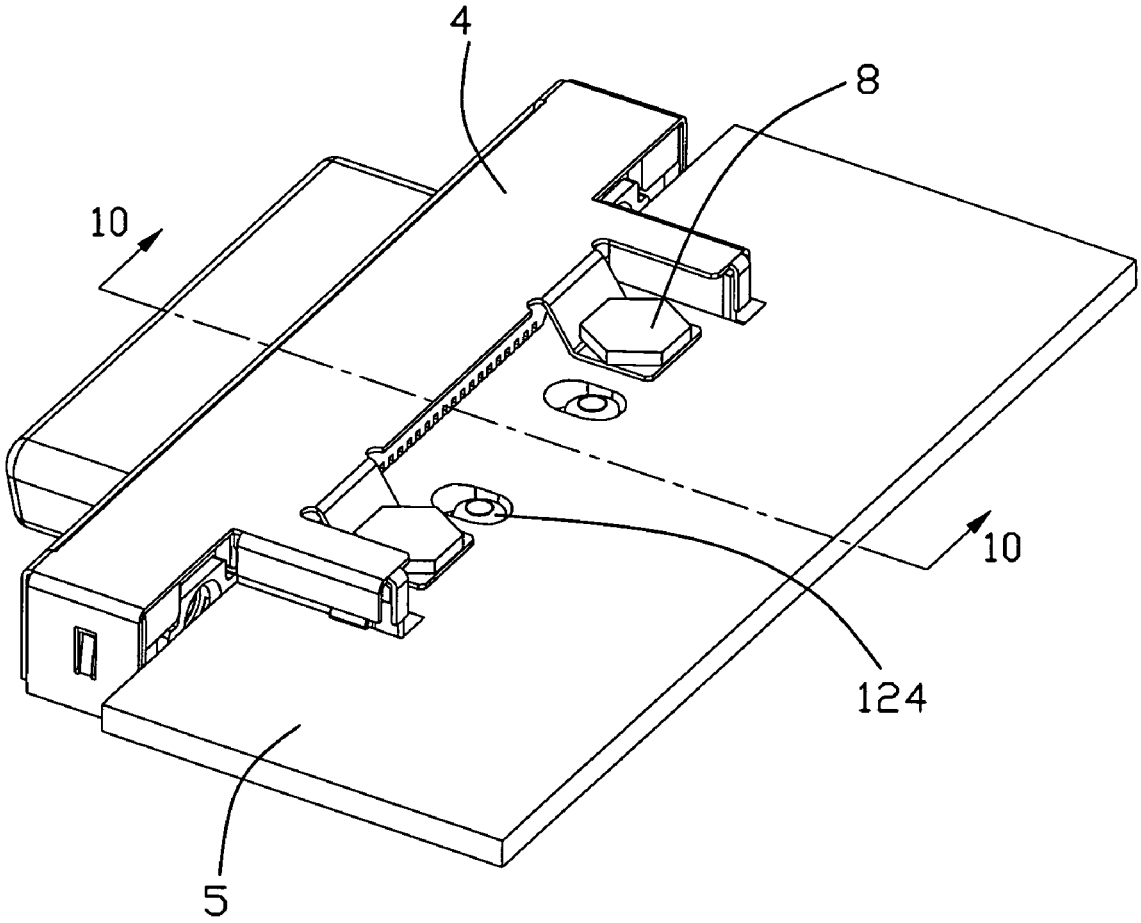
FIG. 2 is another perspective view of the electrical connector assembly shown in FIG. 1.
Figure 3:
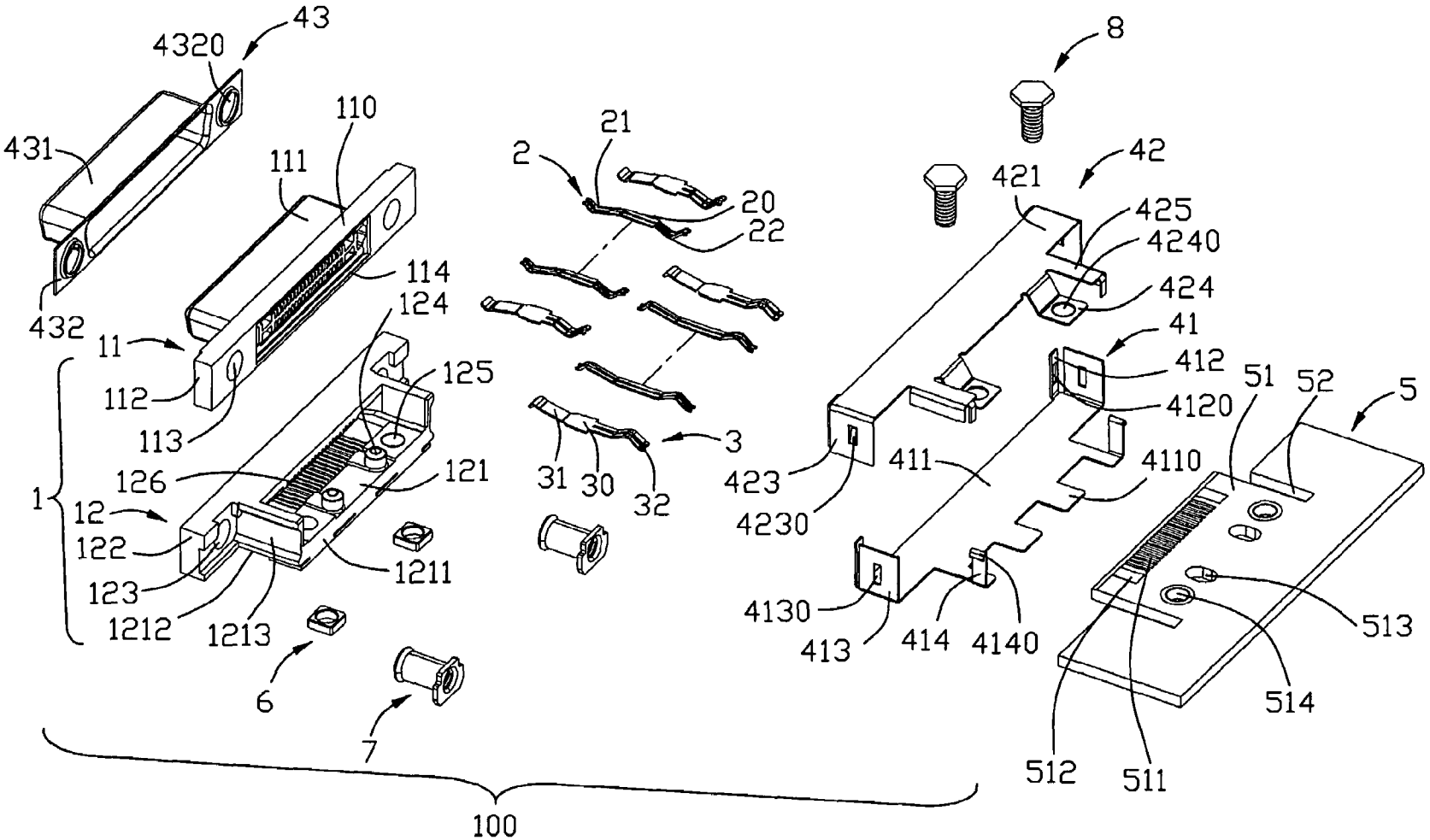
FIG. 3 is an exploded view of the electrical connector assembly shown in FIG. 2.

Referring to FIG. 1 to FIG. 3, an electrical connector assembly includes an electrical connector 100 and a printed circuit board 5 connecting with the electrical connector 100. The electrical connector 100 includes an insulative housing 1, a plurality of first and second contacts 2, 3 retained in the insulative housing, a shell 4 covering on the insulative housing 1 and a locking mechanism. The locking mechanism here includes nuts 6 and bolts 7, 8.

Figure 4:
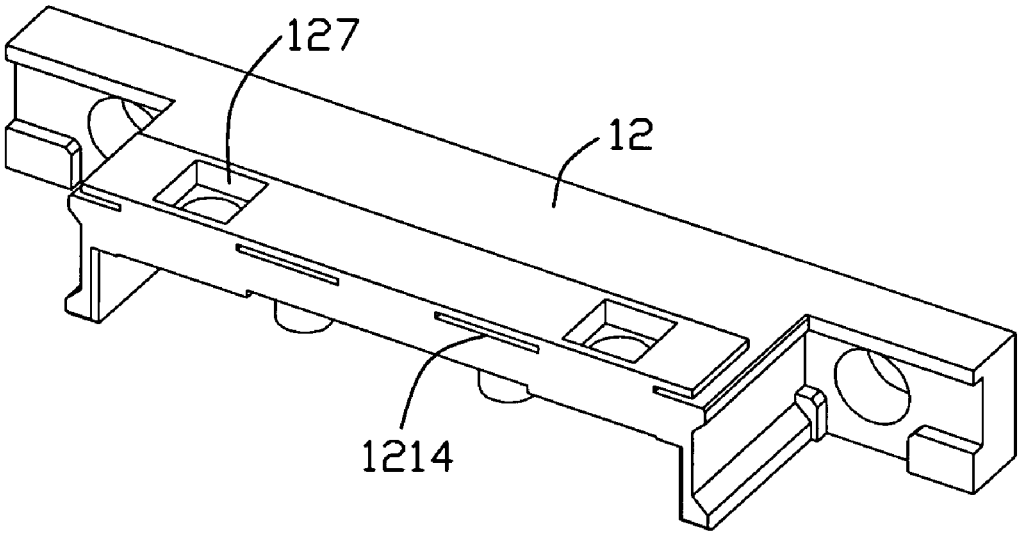
FIG. 4 is a perspective view of a second housing of the electrical connector assembly shown in FIG. 1.

Referring to FIG. 3 and FIG. 4, the insulative housing 1 includes a first housing 11 and a second housing 12. The first housing 11 defines a longitudinal base portion 110 and a D-shaped mating portion 111 extending forwards from the base portion 110 for mating with a mating connector (not shown). The base portion 110 extends beyond the mating portion 111 along a longitudinal direction at two ends thereof to form a pair of first retaining portions 112, each of the retaining portions 112 defines a first through hole 113 running therethrough along a front-to-rear direction. The second housing 12 defines a base portion with a pair of second retaining portion 122 at two ends of the base portion along the longitudinal direction, and a fixing portion 121. Each of the second retaining portion 122 defines a second through hole 123 corresponding to the first through hole 113 defined in the first retaining portions 112. The fixing portion 121 extends rearwards from the base portion and opens upwards and rearwards. A pair of guiding portions 124 extend upwards from an upper surface of a bottom wall 1211 of the fixing portion 121, and a pair of receiving holes 125 run through the bottom wall 1211 in a top-to-lower direction. Each of the receiving holes 125 defines a circular top portion running through the upper surface thereof and a quadrate lower portion 127 running through a bottom surface of the fixing portion 121. The fixing portion 121 defines a pair of opposite side-walls 1212 vertical to the bottom wall 1211. Each of the side-walls 1212 defines a groove 1213 at an outer surface thereof, and the bottom wall 121 defines several slots 1214 at the rear face thereof (labeled in FIG. 4).

Figure 6:
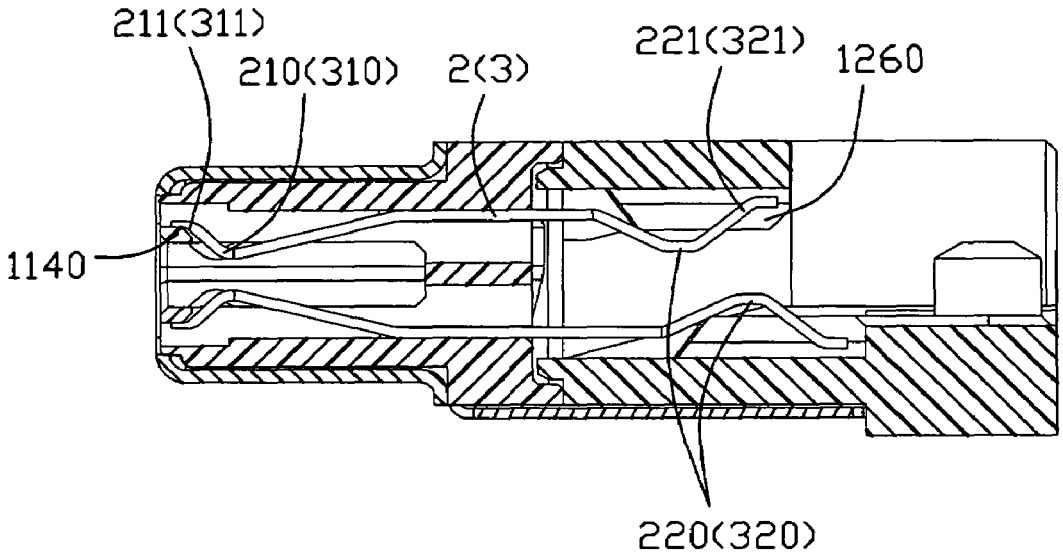

Referring to FIG. 3 and FIG. 6, each of the first contacts 2/second contacts 3 defines a retaining section 20/30, an elastic contacting arm 21/31 extending forwards from the retaining section 20/30 and a compressing arm 22/32 extending rearwards from the retaining section 20. The contacting arm 21/31 is received in a first receiving groove 114 of the first housing 11, and the compressing arm 22/32 is received in a second receiving groove 126 of the second housing 12, the first receiving groove 114 are aligned with the corresponding second receiving groove 126. The elastic arm 21/31 defines a contacting portion 210/310 for contacting with a mating connector. The compressing arm 22/32 defines a compressing portion 220/320 for compressing against the printed circuit board 5. The first contacts 2 and the second contacts 3 are arranged in an upper row and a lower row, and the compressing portions 220 of the two rows are located in different position along the front-to-rear direction. The first and second contacts 2, 3 are inserted into the first housing 11 from a rear face of the base portion 110, the contacting arms 21, 31 and the retaining sections 20, 30 are received in the corresponding first receiving grooves 114, wherein the front ends 211, 311 of the contacting arms 21, 31 block the corresponding blocking portion 1140 (shown in FIG. 6). The second housing 12 is assembled to the first housing 11 from the rear face of the base portion 110, the compressing arms 22, 32 are inserted into the second receiving groove 126 from the front-to-rear direction, and rear ends 221, 321 of the compressing arms 22, 32 block a corresponding blocking portion 1260 provided in the second receiving groove 126 (shown in FIG. 6). The first retaining portions 112 abut against the second retaining portions 122. The two housings 11, 12 are retained together by the bolts 7, which will be described hereinafter. The compressing portions 220, 320 bend towards each other and offset in the mating direction, thereby defining a receiving groove slanting to the top face in the second housing.

Referring to FIG. 3, the shell 4 includes a first shell 41, a second shell 42 and a third shell 43. The first shell 41 defines a first flat main body 411, a pair of first front pieces 412 extending upwards from two ends of a front edge of the first main body 411 and a pair of first end pieces 413 extending upwards from two opposite end edges of the first main body 411. The first main body 411 further extends rearwards and flatly to form a locking portion 4110 thereof, and a pair of elastic locking arms 414 extending upwards are provided at two opposite side edges of the locking portion 4110, a hook portion 4140 is provided at a free end of each locking arms 414 thereof.

Figure 5:
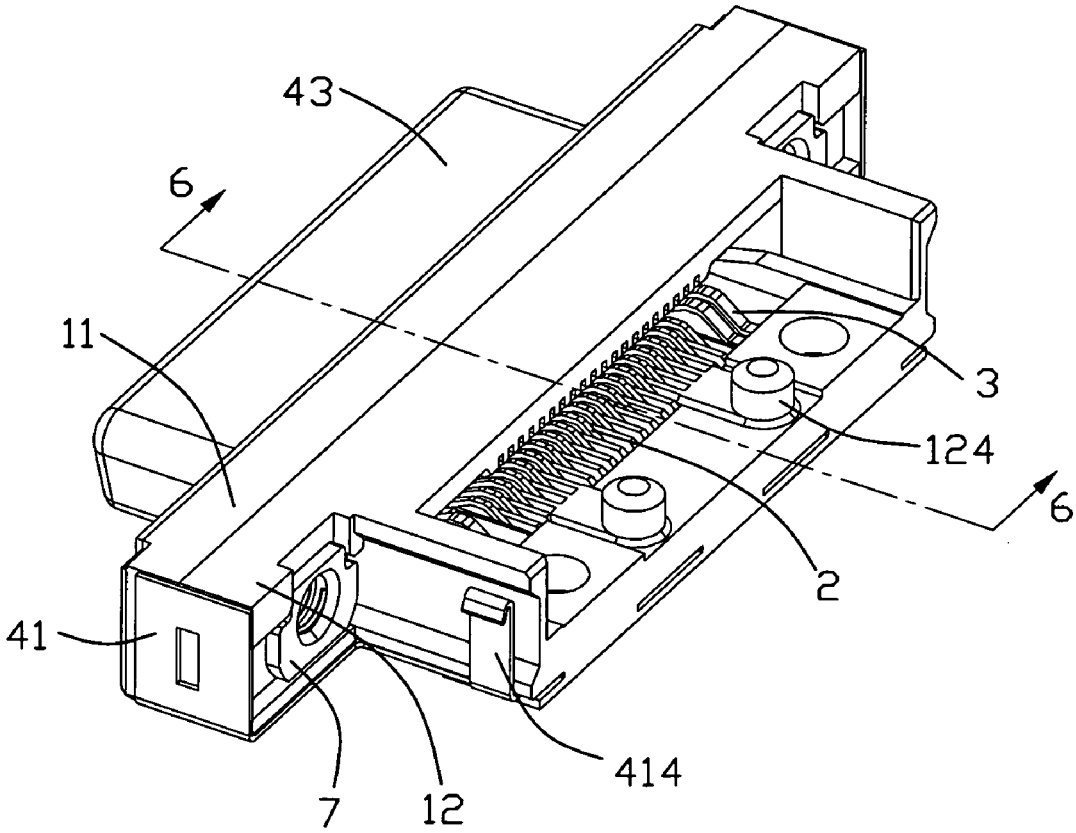
FIG. 5 is a perspective view of an electrical connector shown in FIG. 1 removed a second shell thereof.

The second shell 42 defines a second main body 421, a pair of second front pieces 422 (shown in FIG. 1) extending downwards from two ends of a front edge thereof and a pair of second end pieces 423 extending downwards from two opposite end edges thereof. The second main body 421 further defines a pair of locking members 424 extending from a rear edge of the second main body 421 with a hole 4240 and a pair of covering portions 425 positioned at outer sides of the locking members 424. The third shell 43 defines a mating frame 431 for covering the mating portion 111 and a pair of third retaining portions 432 extending from a rear edge of the mating frame 431 along the longitudinal direction, each of the third retaining portions 432 defines a third through hole 4320 thereof. The third shell 43 is set to cover the first housing 11 with the mating frame 431 surrounding the mating portion 111 and the third retaining portions 432 abut against a front face of the first retaining portion 112. The through holes 4230, 113 and 123 are aligned with each other, and the bolts 7 go into the three through holes 113, 123, 4320 to retain the first housing 11, the second housing 12 and the third shell 43 together steadily (shown in FIG. 5). The nuts 6 are put in the lower portions 127. Then, the first shell 41 is retained to the housing 11 by the locking portion 4110 being retained into the corresponding slots 1214, the first front pieces 412 abut against a front face of the first retaining portion 112, the first end pieces 413 abut against the side walls of the assembled first and second housings 11, 12, each of the locking arms 414 is positioned at an outside of the side-wall 1212 (shown in FIG. 5). The assembled housing 1, contacts 2, 3, the first shell 41, the third shell 43, the nuts 6 and the bolts 7 provide a assembled member as FIG. 5 shown. The second shell 42 is assembled to the housing 1 after the PCB 5 is assembled to housing 1, which will be described hereinafter.

Referring to FIG. 3, the printed circuit board 5 defines a pair of slots 52 and a main board 51 provided between the two slots 52. The main board 51 defines a plurality of pads 511, 512 at two opposite sides thereof, a pair of guiding holes 513 positioned behind the pads 511, 512 and a pair of retaining holes 514.

Figure 7:
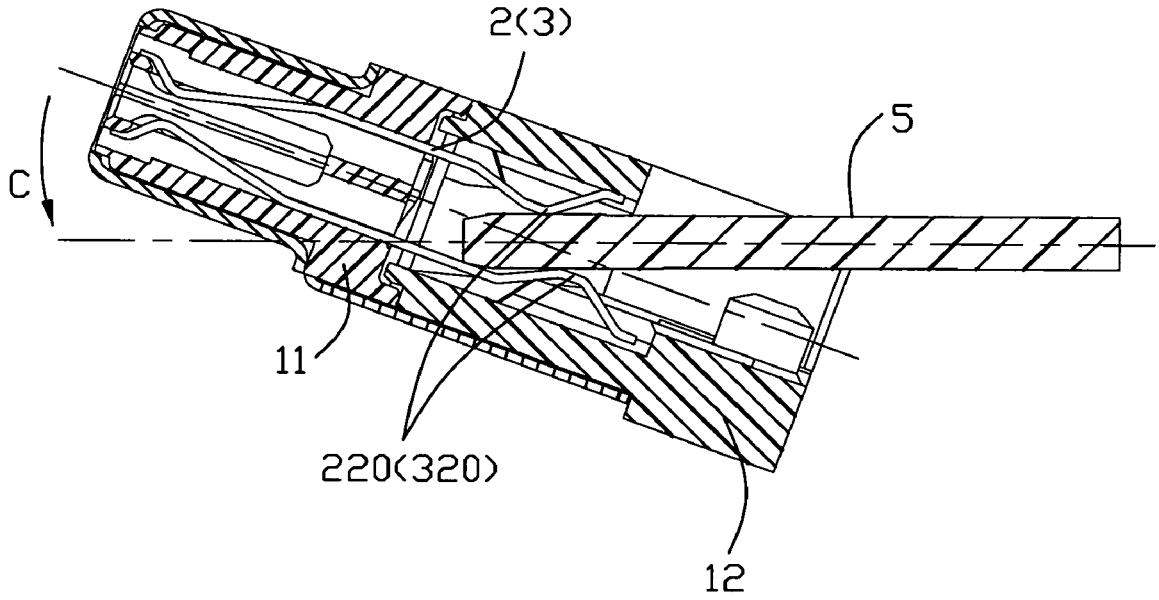
Figure 8:
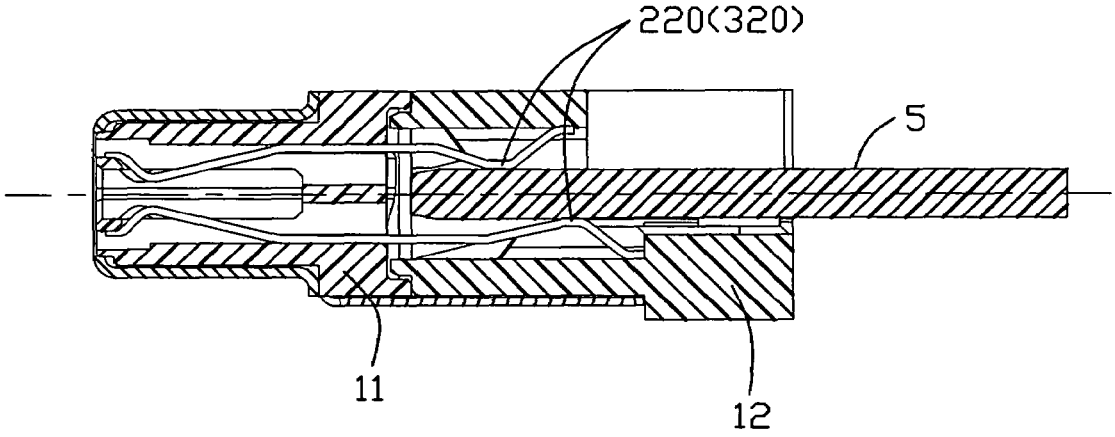
Figure 9:
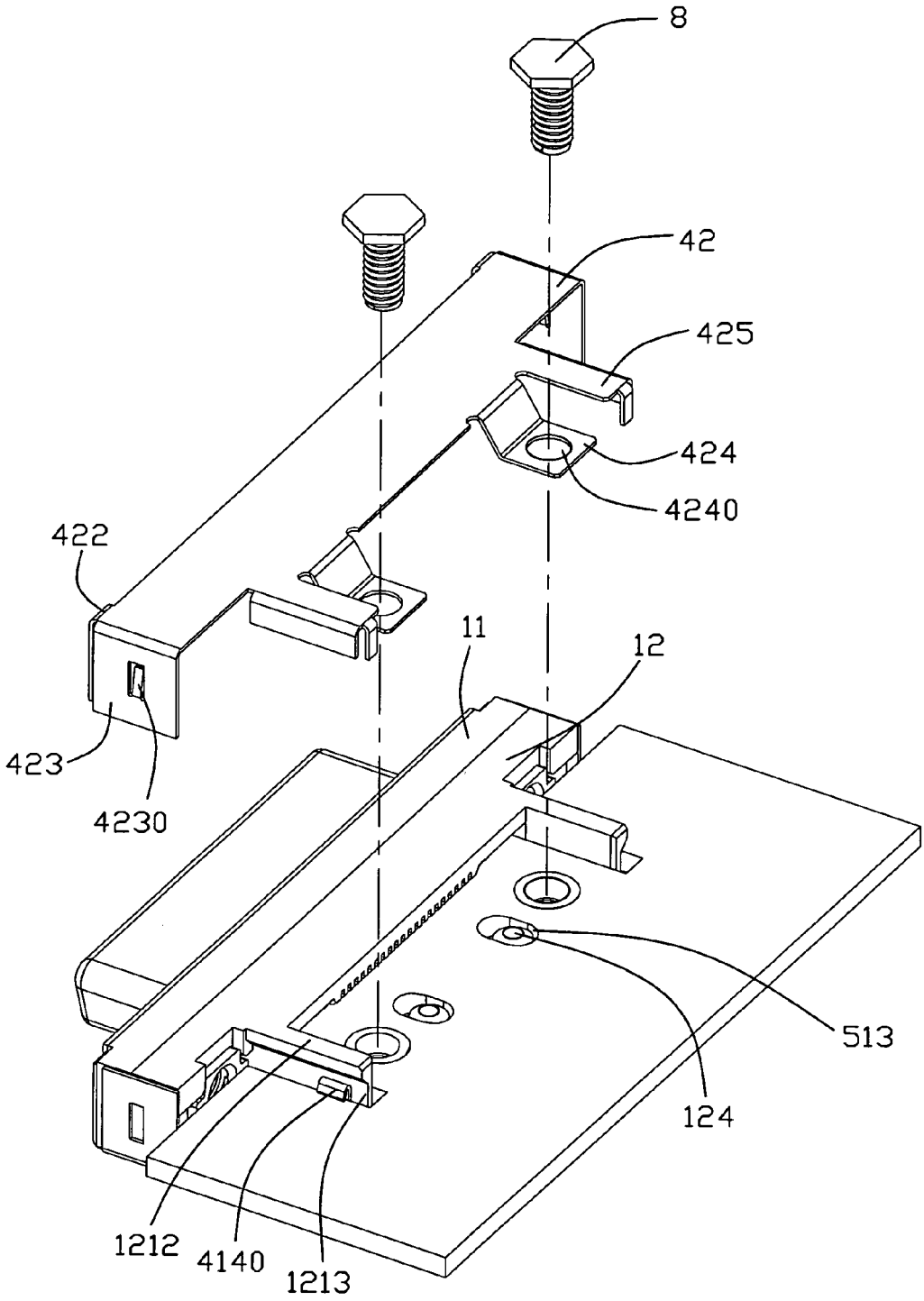
FIG. 9 is a partly exploded view of the electrical connector assembly, showing the second shell and the bolts off.

Referring to FIG. 7 to FIG. 9, the assembled member is slantways set to receive the printed circuit board 5, synchronously, the compressing portions 220, 320 arranged in the upper rows and the lower rows hold the main board 51 therebetween to contact the corresponding pads 511, 512, the side-walls 1212 and the locking arms 414 are received in the slots 52 and guiding portions 214 are received in the corresponding guiding holes 513. Then a free end/mating end of the assembled member (shown in FIG. 5) are rotated downwards along a direction C by the guiding portions 214 cooperating with the guiding holes 513 until the assembled member parallel to the printed circuit board 5, and the locking portions 4110 lock two sides of the board 5. The receiving holes 125 are aligned with the retaining holes 514, and the compressing portions 220, 320 compressed towards an inner surface of the receiving grooves 114, 126 respectively to make the free ends contact the inner surface. The compressing portions 220, 320 located in two opposite sides of the printed circuit board 5 elastically compress the pads 511, 512 to retain the assembled member to the printed circuit board 5.

Figure 10:
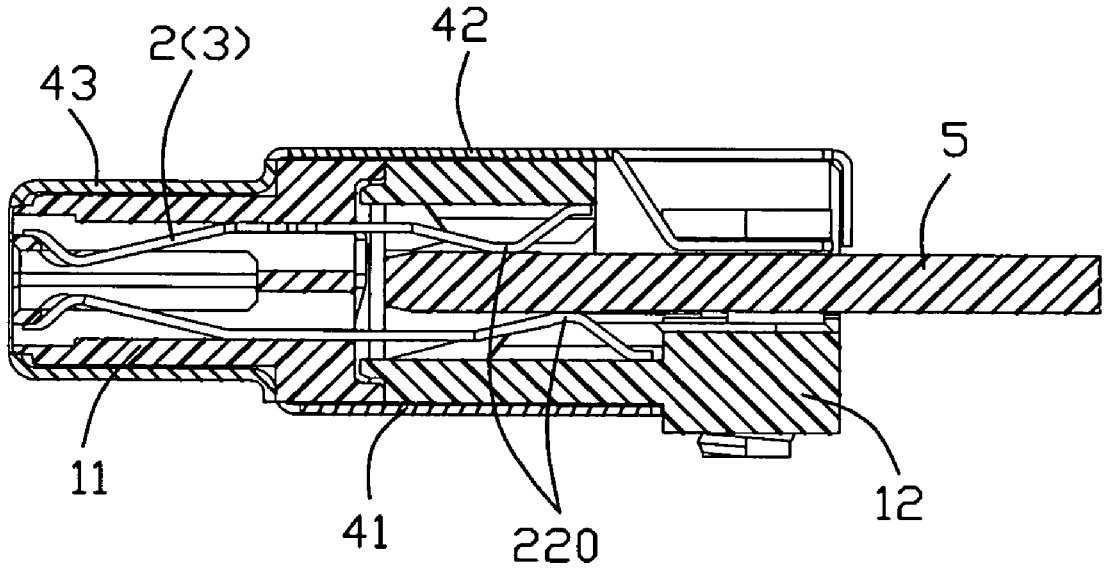
FIG. 10 is a cross-sectional view of the electrical connector assembly taken along line 10-10 of FIG. 2.

Referring to FIG. 1, FIG. 9 and FIG. 10, the second shell 42 is assembled to the assembled member in a top-to-bottom direction after the assembled member retained to the board 5, the second front pieces 422 abut against the corresponding first front pieces 412 with the elastic pieces 4220 entering into the holes 4120, the second end pieces 423 abut against the corresponding first end pieces 413 with the elastic pieces 4320 entering into the holes 4130, the holes 4240 are aligned with the corresponding retaining holes 514, and the pair of covering portions 425 cover on the side-walls 1212. Each of the bolts 8 runs through the hole 4240, the retaining hole 514 and the top portion, and then twists into the nut 6 to retain the bolt 8 thereof, and at that time, the electrical connector 100 is assembled and retained to the printed circuit board 5 steadily. The compressing portions 220, 320 sandwich and compress against the printed circuit board 5 from two opposite sides instead of being soldered thereto to connect the contacts 2, 3 to the printed circuit board 5, which can make the assemblage easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembled to a printed circuit board for connecting with a mating connector, comprising:

a longitudinal insulative housing; and a plurality of contacts received in the housing, each of the contacts defining a retaining section, a contacting portion extending forwards from the retaining section for contacting with the mating connector and a compressing portion extending rearwards from the retaining section for connecting to the printed circuit board;

wherein the compressing portions are arranged in two rows, and the compressing portions nip and elastic compress against the printed circuit board instead of being soldered thereto to connect the electrical connector to the printed circuit board steadily.

2. The electrical connector as described in claim 1, wherein the two rows of the compressing portions bend towards each other and offset in a mating direction.

3. The electrical connector as described in claim 1, wherein the housing defines a plurality of receiving grooves therein, and each free end of the compressing portions is received in a corresponding receiving groove.

4. The electrical connector as described in claim 3, wherein each of the receiving grooves defines a blocking portion thereof, the free end of each compressing portion abut against the blocking portion, after the connector assembled to the printed circuit board, the compressing portion is compressed towards an inner surface of the receiving groove to make the free end contact the inner surface.

5. The electrical connector as described in claim 1, wherein the housing defines guiding portions extending upwards, the printed circuit board defines corresponding guiding holes to cooperate with the guiding portions.

6. The electrical connector as described in claim 1, wherein the electrical connector defines a first shell covering on the housing, the first shell defines a pair of locking arms for locking with the printed circuit board.

7. An electrical connector assembly for connecting with a mating connector, comprising:

a printed circuit board; and an electrical connector assembled to the printed circuit board, comprising:

a insulative housing;

a shell covering on the housing; and a plurality of contacts received in the housing, each of the contacts defining a retaining section, a contacting portion extending forwards from the retaining section for contacting with the mating connector and a compressing portion extending rearwards from the retaining section for connecting to the printed circuit board;

wherein the compressing portions are arranged in two rows, the electrical connector is set slantways to make the two rows of the compressing portions sandwich the printed circuit board, and after the electrical connector is rotated to parallel to the printed circuit board, the electrical connector is connected to the printed circuit board by the compressing portions nipping and elastic compressing against the printed circuit board without soldering.

8. The electrical connector assembly as described in claim 7, wherein the two rows of the compressing portions are located in different positions along a mating direction.

9. The electrical connector assembly as described in claim 7, wherein the shell defines a pair of locking arms for locking with the printed circuit board.

10. An electrical connector assembly comprising:

an insulative housing defining opposite front and rear regions;

two rows of contacts disposed in the housing and defining opposite mating and mounted sections respectively at the front and rear regions;

a printed circuit board located behind the rear region and defining opposite first and second surfaces thereof;

a first shell assembled upon the housing and located upon the first surface;

a second shell assembled upon the housing and located upon the second surface; wherein rear portions of said first shell and said second shell are separated from each other by said printed circuit board while front portions of the first shell and the second shell are joined together.

11. The electrical connector assembly as claimed in claim 10, wherein the printed circuit board defines a pair of slots extending through said first and second surfaces, and the rear region of the housing defines two opposite walls extending therethrough.

12. The electrical connector assembly as claimed in claim 10, wherein said second shell defines a pair of latches extending therethrough the corresponding slots.

* * * * *